US007533966B2

(12) United States Patent
Onozawa

(10) Patent No.: US 7,533,966 B2
(45) Date of Patent: May 19, 2009

(54) MIST SPRAYING APPARATUS AND METHOD, AND IMAGE FORMING APPARATUS

(75) Inventor: Sho Onozawa, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 422 days.

(21) Appl. No.: 11/412,094

(22) Filed: Apr. 27, 2006

(65) Prior Publication Data

US 2006/0244786 A1 Nov. 2, 2006

(30) Foreign Application Priority Data

Apr. 28, 2005 (JP) ..... 2005-132370

(51) Int. Cl.
*B41J 2/06* (2006.01)

(52) U.S. Cl. ..... 347/55

(58) Field of Classification Search ..... 347/47, 347/55, 74–76

See application file for complete search history.

(56) References Cited

U.S. PATENT DOCUMENTS 4,281,333 A * 7/1981 Tsuzuki et al. ..... 347/15
6,623,113 B2 * 9/2003 Yamada et al. ..... 347/77

FOREIGN PATENT DOCUMENTS

| | | | |
|---|---|---|---|
| JP | 62-85948 | A | 4/1987 |
| JP | 62-111757 | A | 5/1987 |
| JP | 2-134250 | A | 5/1990 |
| JP | 5-57891 | A | 3/1993 |

OTHER PUBLICATIONS

Kameyama et al., The Journal of the Acoustical Society of Japan, vol. 60, No. 2, 2004, pp. 53-60.

* cited by examiner

*Primary Examiner*—An H Do
(74) *Attorney, Agent, or Firm*—Birch, Stewart, Kolasch & Birch, LLP

(57) ABSTRACT

The mist spraying apparatus includes: a liquid chamber into which liquid is filled; an ejection port through which the liquid is ejected from the liquid chamber; a first electrode which is in contact with the liquid and charges the liquid; a vibration generating device which converts the liquid into droplets by applying vibrational energy to the liquid inside the liquid chamber, thereby generating a charged mist; a rear surface electrode which is disposed so as to oppose an ejection surface including the ejection port, and holds a liquid receiving medium onto which the charged mist is deposited from the ejection port; and a second electrode which is disposed at a position in an outward radial direction from an edge of the ejection port, and generates an electric field between the second electrode and the rear surface electrode, the electric field accelerating and converging the charged mist ejected from the ejection port toward the liquid receiving medium.

9 Claims, 14 Drawing Sheets

| REGION | ρ(C) | ε(F/m) |
|---|---|---|
| NOZZLE ELECTRODE REGION | 0.2 | $2.3\varepsilon_0$ |
| OPPOSING ELECTRODE REGION | 0 | $2.3\varepsilon_0$ |
| CLEARANCE REGION | 0 | $\varepsilon_0(=8.85418782\times10^{-12})$ |
| INK REGION | 0.2 | $88\times\varepsilon_0$ |

MIST SPRAYING APPARATUS AND METHOD, AND IMAGE FORMING APPARATUS

BACKGROUND OF THE INVENTION

1. Field of the Invention

The present invention relates to a mist spraying apparatus and method, and an image forming apparatus, and more particularly to an apparatus and method for spraying a liquid in the form of a mist, by using ultrasonic waves, and to an image forming apparatus which records images by means of a group of ink micro-particles (ink mist) sprayed as a mist.

2. Description of the Related Art

There is an ink mist type of image recording apparatus (ink mist printer) which records images by generating a flow of ink mist (very fine ink particles) by means of ultrasonic vibration, and depositing this ink mist onto a recording medium as a group (cluster), (see, for example, Japanese Patent Application Publication Nos. 62-85948, 62-111757, 2-134250 and 5-57891). Furthermore, a composition of a print head using concentrated ultrasonic waves and nozzles has also been proposed ("Study on Ink Ejection of Print Head Using Focused Ultrasonic Wave and Nozzle" (Shumpei Kameyama, Hiroshi Fukumoto, and Shusou Wadaka, Journal of the Acoustical Society of Japan, Vol. 60, No. 2, (2004), pp. 53-60)).

Since the mist is a collection (cluster) of fine liquid droplets, it is highly subject to variations caused by prolongation in the flight time of the liquid droplets due to the effects of air resistance, and disturbance by external air flows. Therefore, a device is used to accelerate the movement of the fine liquid droplets forming the mist cluster by charging the droplets and applying an electric field (see Japanese Patent Application Publication Nos. 62-85948 and 62-111757, for example), but in this case, the mist cluster expands due to the occurrence of a Coulomb repulsion effect between the charged fine liquid droplets, and therefore it is essentially impossible to avoid enlargement of the dot diameter when the ink lands on the medium. Moreover, the mist is susceptible to air disturbance, and the horizontal expansion (flattening) of the clusters due to air currents near the target cannot be ignored.

SUMMARY OF THE INVENTION

The present invention has been contrived in view of such circumstances, and an object thereof is to provide a mist spraying apparatus and method whereby mist clusters can be converged and dots can be prevented from expanding in diameter, and to provide an image forming apparatus that uses the same.

In order to attain the aforementioned object, the present invention is directed to a mist spraying apparatus, comprising: a liquid chamber into which liquid is filled; an ejection port through which the liquid is ejected from the liquid chamber; a first electrode which is in contact with the liquid and charges the liquid; a vibration generating device which converts the liquid into droplets by applying vibrational energy to the liquid inside the liquid chamber, thereby generating a charged mist; a rear surface electrode which is disposed so as to oppose an ejection surface including the ejection port, and holds a liquid receiving medium onto which the charged mist is deposited from the ejection port; and a second electrode which is disposed at a position in an outward radial direction from an edge of the ejection port, and generates an electric field between the second electrode and the rear surface electrode, the electric field accelerating and converging the charged mist ejected from the ejection port toward the liquid receiving medium.

According to the present invention, the liquid is charged when voltage is applied to the first electrode while the first electrode is in contact with the liquid, and charged mist is ejected from the ejection ports by driving the vibration creating device. The charged mist ejected from the ejection ports is accelerated while being converged by the electrostatic force of the electric field formed in the space between the rear surface electrode and the second electrode, and the mist is deposited on the liquid receiving medium. The dots being deposited are thereby prevented from expanding in diameter.

The distribution of space potential needed to converge the charged mist is achieved by establishing the shape and patterning of the rear surface electrode and the second electrode, the potential of each of the electrodes, and other such factors. Since a uniform electric field with evenly parallel electric flux lines is insufficient to overcome the coulomb repulsion between the charged micro-particles and to converge the mist clusters, then a nonuniform electric field is formed wherein the space potential outside of the target position of the convergence is higher than the space potential near the target position of the convergence (the space potential near the target position of the convergence is lower).

Preferably, the mist spraying apparatus further comprises a nozzle plate in which the ejection port is formed, the nozzle plate having a liquid-contacting surface which functions as the first electrode and an uneven surface which functions as the second electrode.

It is possible to use a configuration wherein the nozzle plate itself on which the ejection ports are formed is used as an electrode member that functions as the first electrode and the second electrode, and the electrode shape of the nozzle plate facing the rear surface electrode is formed into an uneven (unflat) surface, whereby the nonuniform electric field is formed, and the mist clusters can thereby be converged and deposited on the liquid receiving medium.

Preferably, a flaring recess is formed on the ejection surface of the nozzle plate around the ejection port, a cross-sectional area of the flaring recess gradually increasing from the ejection port along an ejection direction of the liquid; and the uneven surface includes the flaring recess and periphery thereof.

The nonuniform electric field is formed by forming the electrode flared surfaces on the outsides of the ejection ports, whereby the mist clusters can be converged and deposited on the liquid receiving medium.

Alternatively, it is also preferable that a recess is formed on the ejection surface of the nozzle plate around the ejection port, the recess having an opening larger than the ejection port and a flat surface perpendicular to an ejection direction of the liquid within a specific distance in the outward radial direction from the edge of the ejection port; and the uneven surface includes the recess and periphery thereof.

It is possible to use a configuration wherein the convergence electrodes protrude from positions separated from the edges of the ejection ports by a specific distance.

Alternatively, it is also preferable that the mist spraying apparatus further comprises: a first nozzle electrode member in which the ejection port is formed, the first nozzle electrode member having a liquid-contacting surface which functions as the first electrode; a second nozzle electrode member which is disposed on the ejection surface of the first nozzle electrode member at a specific distance in the outward radial direction from the edge of the ejection port, the second nozzle electrode member functioning as the second electrode; a first voltage application device which applies a first voltage to the first nozzle electrode member; and a second voltage application device which applies a second voltage higher than the first voltage to the second nozzle electrode member.

The first electrode and the second electrode are configured from separate nozzle electrode members, and different voltages are applied to the nozzle electrode members, whereby the nonuniform electric field is formed, and the mist clusters can thereby be converged and deposited on a liquid receiving medium.

In this case, the functions of the electrodes can be reliably separated by placing an insulating layer (insulating member) between the first nozzle electrode member and the second nozzle electrode member, and creating electrical insulation between the two electrodes.

The voltage values of the first voltage applied by the first voltage application device and the second voltage applied by the second voltage application device are set to appropriate values according to the arrangement of the electrodes (for example, the distance between the electrodes) and other such device conditions as well as the preferred dot diameter and preferred deposition time and other such conditions.

Preferably, the second nozzle electrode member includes an electromagnetic lens.

The charged mist can be converged more efficiently by using then electromagnetic lens.

Preferably, the vibration generating device is constituted by a piezoelectric element; and a drive control device is provided to output a drive signal which causes the piezoelectric element to vibrate ultrasonically.

The piezoelectric element can be suitably used as the device which creates the vibration energy needed to turn the liquid into mist.

In order to attain the aforementioned object, the present invention is also directed to an image forming apparatus comprising the above-described mist spraying apparatus, which forms an image on the liquid receiving medium by means of the droplets ejected from the ejection port.

The driving of the vibration creating device is controlled based on inputted image data, and charged mist (droplets) is ejected from the ejection ports. Clusters of the ejected charged mist are converted and accelerated by the electrostatic force of the nonuniform electric field, and are deposited on a liquid receiving medium. Dots are thus formed by the mist clusters deposited on the liquid receiving medium. The desired images (dot arrangements) can be recorded on the liquid receiving medium by controlling the ejection timing and the ejected amounts of droplets according to image data. According to the image forming apparatus of the present invention, it is possible to form images of high quality at high speeds.

In order to achieve high-resolution image output, it is preferable to use a mist ejection head obtained by aligning a plurality of ejection ports for ejecting liquid, and a plurality of ejection elements (liquid chamber units) configured including pressure chambers and vibration creating devices corresponding to the ejection ports. In this case, the charging electrodes, the accelerating electrodes, or the charging and accelerating electrodes are provided to the ejection surface of the mist ejection head.

A full-line type mist ejection head having nozzle-rows in which a plurality of ejection ports (nozzles) are aligned over a length that corresponds to the entire width of the liquid receiving medium can be used as a structural example of the mist ejection head.

In one embodiment of this case, a plurality of relatively short ejection head modules that have nozzle rows shorter than the entire width of the liquid receiving medium are combined, and these head modules are joined together to configure nozzle rows of a length that corresponds to the entire width of the liquid receiving medium.

A full-line type mist ejection head is normally disposed along a direction orthogonal to the relative feeding direction (relative conveyance direction) of the recording medium, but another possible embodiment is to dispose the mist ejection head along a direction slanted at a specific angle in relation to the direction orthogonal to the conveyance direction.

When color images are formed, a full-line type head may be disposed separately for each of a plurality of ink colors, or the configuration may be designed such that a plurality of ink colors can be ejected from one head.

The term "liquid receiving medium" refers to a medium onto which liquid ejected from the ejection ports is deposited, and the equivalent of the medium used in an image forming apparatus is recording paper or another such recording medium. Specifically, the "liquid receiving medium" can also be referred to as a recording medium, printing medium, image formation medium, recorded medium, image receiving medium, or the like, and includes various media regardless of their material or shape, such as continuous paper, cut paper, sealing paper, OHP sheets and other such resin sheets, films, cloth, printed boards on which wiring patterns are formed, and intermediate transfer printing mediums.

The conveying device which moves the liquid receiving medium and the mist ejection head relatively to each other includes an embodiment wherein the liquid receiving medium is conveyed relative to a stationary (fixed) head, an embodiment wherein the head is moved relatively to a stationary (fixed) liquid receiving medium, and an embodiment wherein both the head and the liquid receiving medium are moved.

In order to attain the aforementioned object, the present invention is also directed to a mist spraying method, comprising the steps of: charging liquid filled in a liquid chamber by S applying a voltage to a first electrode which is in contact with the liquid, and generating a charged mist by converting the liquid into droplets by applying a vibrational energy to the liquid; ejecting the charged mist through an ejection port toward a liquid receiving medium held on a rear surface electrode disposed so as to oppose an ejection surface including the ejection port of the charged mist; generating a nonuniform electric field between a second electrode and the rear surface electrode, the second electrode being disposed at a position in an outward radial direction from an edge of the ejection port; and depositing the charged mist on the liquid receiving medium, by accelerating and converging the charged mist by means of electrostatic force of the nonuniform electric field.

According to the present invention, the dots being deposited can be prevented from expanding in diameter, because of a configuration in which an electric field suitable for converging mist clusters is created between the ejection ports for the charged mist and the rear surface electrode, and the charged mist is deposited on a liquid receiving medium while being converged and accelerated by the action of this electric field.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DESCRIPTION OF THE PREFERRED EMBODIMENTS

First Embodiment

Figure 1:
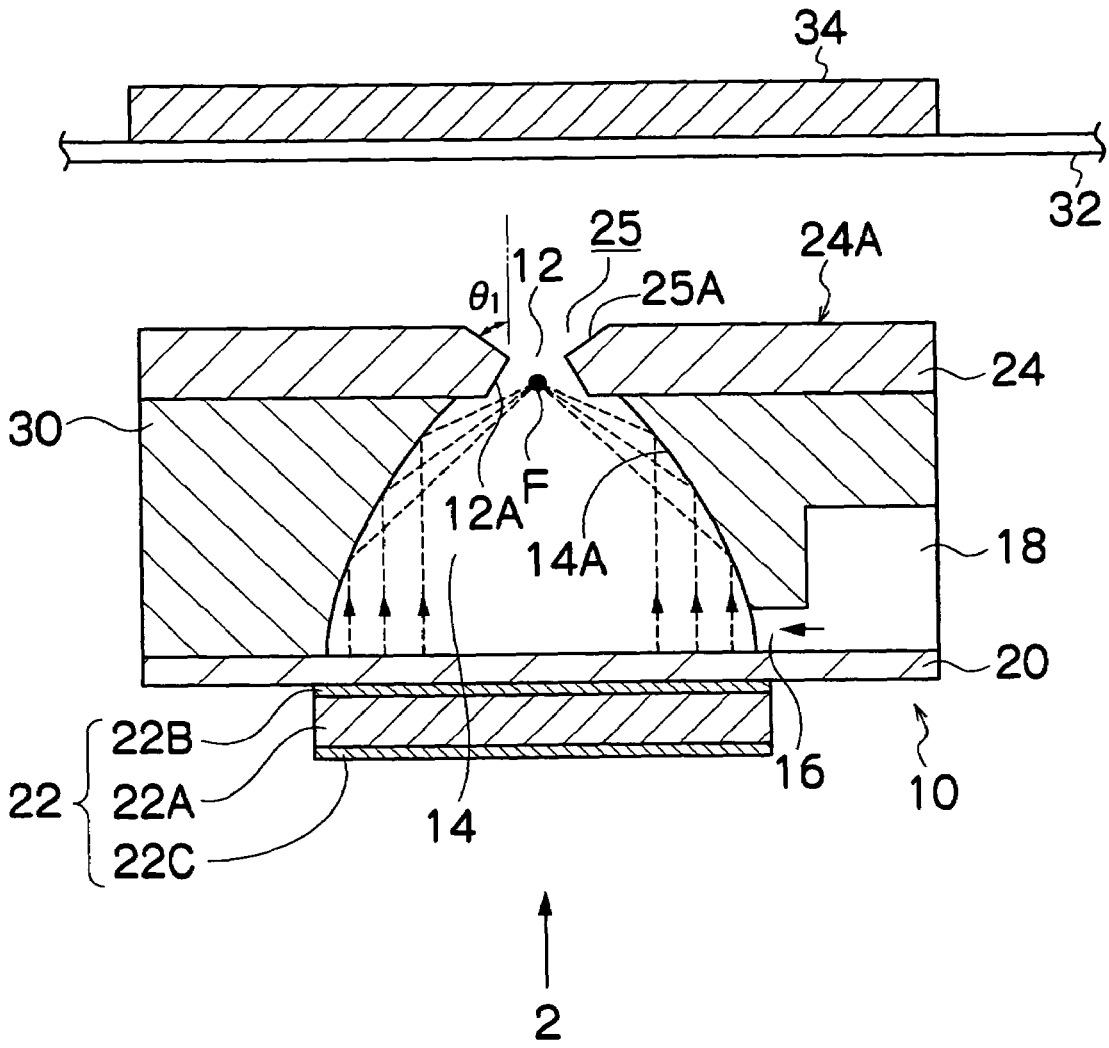
FIG. 1 is a cross-sectional diagram showing the basic composition of a mist spraying apparatus according to a first embodiment of the present invention.

FIG. 1 is a cross-sectional view showing the basic configuration of a mist spraying apparatus according to a first embodiment of the present invention. The mist spraying apparatus 10 shown in FIG. 1 includes a nozzle 12 as an ejection port for ink mist, an ink chamber 14, an ink supply port 16, a common flow channel 18 which accommodates ink to be supplied to the ink chamber 14, an insulating resin film 20, and a piezoelectric element 22. FIG. 1 shows a cross-sectional view of an ink chamber unit corresponding to one nozzle 12 (the liquid droplet ejection element for one channel). When this ink chamber unit is applied to a print head (also referred to as a "recording head") or another such mist ejecting head, a plurality of channels are arrayed either one-dimensionally (in a row) or two-dimensionally (across a plane).

The nozzle plate 24 in which the nozzles 12 are formed is constituted by a conducting material, such as metal, and also serves as a charging electrode (the first electrode) for charging the ink liquid, and a convergence and acceleration electrode (the second electrode) that converges and accelerates the charged mist.

The nozzle 12 has a tapered shape wherein the cross-sectional area (inside diameter) gradually decreases from the side of the nozzle plate 24 adjacent to the ink chamber 14 (the bottom side in FIG. 1) in the direction of ink ejection (the upward direction in FIG. 1). A recess 25 with a flared shape, in which the cross-sectional area (inside diameter) gradually increases in the direction of ink ejection, is formed in the ink ejection side of the nozzle plate 24 (the top side in FIG. 1, which is the side reverse to the side adjacent to the ink chamber 14) along the outer periphery of the nozzle 12 (ejection port).

In the nozzle plate 24 in FIG. 1, the inner surface 12A of the nozzle 12 and the surrounding area, which are in contact with the ink, function as the charging electrode (the first electrode), and the uneven (unflat) electrode surface that is composed of the inner surface 25A of the flared recess 25 formed on the outside of the ejection opening of the nozzle 12 and a flat area 24A around the recess 25 functions as the convergence and acceleration electrode (the second electrode).

For the sake of convenience in the descriptions, the inner surface 25A of the recess 25 is hereinafter referred to as the "convergence electrode receding surface 25A".

The flaring angle $\theta_1$ of the convergence electrode receding surface 25A (which angle $\theta_1$ is the angle of the inclined surface on one side opening to the outside with respect to the direction of ink ejection, as shown in FIG. 1) is preferably 60 degrees or greater ($\theta_1 \geqq 60°$) so that the electric flux lines of the convergence and acceleration electric field are not drawn into the nozzle 12.

The flat area 24A (the horizontal area in FIG. 1) of the nozzle plate 24 around the convergence electrode receding surface 25A functions as the electrode that contributes toward creating the electric flux lines needed to form an electric field suitable for converging the mist by means of the difference in shape with the convergence electrode receding surface 25A. The flat area 24A is hereinafter referred to as the "convergence electrode external surface 24A". More specifically, in the present embodiment, the electrode surface that includes the convergence electrode receding surface 25A and the convergence electrode external surface 24A serves as the second electrode.

The inner circumferential face of the ink chamber 14 has a parabolic shape, and an ink chamber forming plate 30 and the nozzle plate 24 are bonded together in such a manner that the center of the opening on the ink chamber 14 side of the nozzle 12 is located at the focal point F of the parabolic surface 14A. The parabolic surface 14A forms a reflecting plate reflecting ultrasonic waves generated by the piezoelectric element 22, and therefore, in order to achieve high reflectivity, it is desirable to use a metal material for the ink chamber forming plate 30.

The resin film 20 is arranged on the side of the ink chamber forming plate 30 reverse to the nozzle plate 24, and is bonded to the ink chamber forming plate 30 in a composition which seals off one face of the ink chamber 14 (the bottom face in FIG. 1). Ink introduced from the common flow channel 18 through the ink supply port 16 is filled into the space (ink chamber 14) surrounded by the parabolic surface 14A, the resin film surface 20, and the nozzle plate 24.

The piezoelectric element 22 functions as a vibrating element and is bonded on the surface (the lower surface in FIG.

Figure 2:
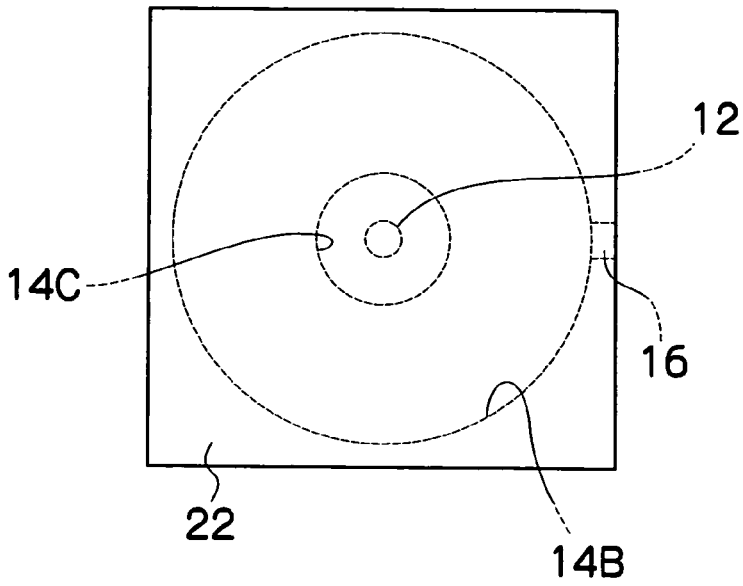
FIG. 2 is a plan diagram viewed in the direction of arrow 2 in FIG. 1.

1) of the resin film 20 reverse to the surface thereof adjacent to the ink chamber 14. FIG. 2 shows a plan diagram of the piezoelectric element 22 (a view in the direction of the arrow 2 in FIG. 1). As shown in FIG. 2, the piezoelectric element 22 has a surface area which covers the upstream side opening 14B of the parabolic surface 14A. FIG. 2 shows an embodiment comprising a substantially square-shaped piezoelectric element 22 having a surface area larger than the upstream side opening 14B of the parabolic surface 14A, but the planar shape of the piezoelectric element 22 is not limited to being a square shape, and it may also be another quadrilateral shape, such as a rectangular or rhombic shape, or a hexagonal shape, octagonal shape, or other polygonal shape, or a circular or elliptical shape, or the like. In FIG. 2, the dotted circle denoted with the reference numeral 14C is the downstream side opening of the parabolic surface 14A (the edge of the opening which is in contact with the nozzle plate 24) (see FIG. 1).

As shown in FIG. 1, the piezoelectric element 22 has a structure in which electrodes 22B and 22C are formed on either surface of a piezoelectric body 22A. In the embodiment shown in FIG. 1, the electrode 22B on the side bonded to the resin film 20 is a common electrode, and the electrode 22C on the other side is an independent drive electrode (hereinafter referred to as the "individual electrode").

In this composition, by applying a high-frequency drive signal (drive voltage) to the individual electrode 22C of the piezoelectric element 22, the piezoelectric element 22 is made to vibrate and generate an ultrasonic wave. The resin film 20 vibrates in conjunction with the piezoelectric element 22, due to its flexibility, and hence the ultrasonic wave radiates into the ink through the resin film 20.

The ultrasonic wave radiating into the ink from the piezoelectric element 22 propagates through the ink chamber 14, through the medium of the ink, and converges in the vicinity of the focal point F (in the vicinity of the central region of the nozzle 12), due to reflection at the parabolic surface 14A. FIG. 1 shows a schematic diagram in which the directions of travel of the wave fronts of the pressure waves having the ultrasonic frequency are indicated by broken lines. Due to the energy of the concentrated ultrasonic wave, a capillary wave intrinsic to the frequency is generated in the liquid surface (meniscus) in the nozzle section 12, and fine droplets of the ink become separated from the wave peaks in the minute surface wave thus created. Consequently, a collection of fine particles of the ink in the form of a mist (a mist cluster) is sprayed from the nozzle 12.

A recording medium (liquid receiving medium) 32 such as recording paper is conveyed while maintaining a uniform distance from the ink ejecting surface (the flat face of the convergence electrode external surface 24A in FIG. 1) of the nozzle plate 24. A flat plate-shaped rear surface electrode 34 is disposed on the rear surface of the recording medium 32 (reverse to the recording surface on which ink particles are deposited), and the recording medium 32 is held (supported) by the rear surface electrode 34. By applying a direct current voltage between the nozzle plate 24 (the nozzle electrode) and the rear surface electrode 34, the ink liquid in the nozzle section is charged with a positive charge, and the electric field (acceleration electric field that has the effect of converging mist) is generated between the electrodes 24 and 34, and the charged mist sprayed from the nozzle 12 is accelerated by the resulting electrostatic force and is deposited onto the recording medium 32.

Figure 3:
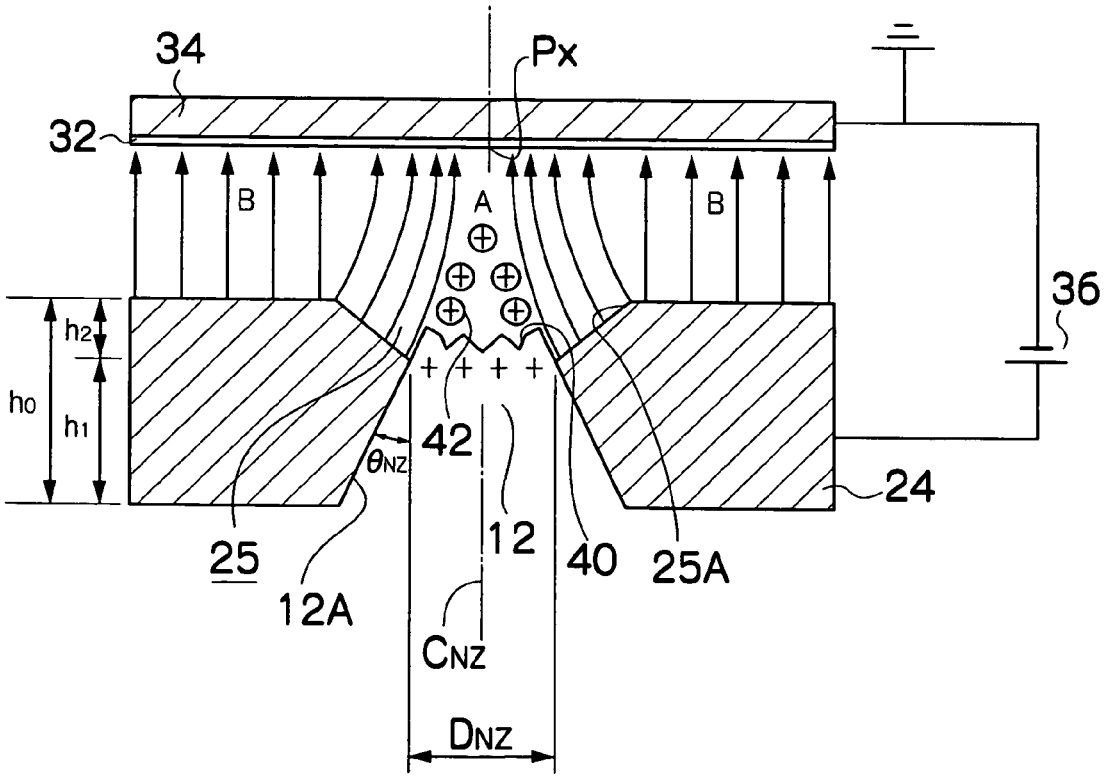
FIG. 3 is an enlarged diagram showing a schematic view of the nozzle section.

FIG. 3 is an enlarged diagram showing a schematic view of the nozzle section. The earthed rear surface electrode 34 is disposed in parallel with the nozzle plate 24, and functions as the opposing electrode for the nozzle electrode configured from the nozzle plate 24. As shown in FIG. 3, the positive pole of a charging and accelerating power source 36 is connected to the nozzle electrode (nozzle plate 24), and a specific direct current voltage is applied to the nozzle electrode (nozzle plate 24). Driving the piezoelectric element 22 (see FIG. 1) in this state of applied voltage causes an electric charge to be induced in the liquid surface 40 in the nozzle 12, and causes clusters (charged mist) of positively charged ink micro-particles 42 to be sprayed from the liquid surface 40, as shown in FIG. 3.

The electric field that converges and accelerates the clusters of charged ink micro-particles 42 toward the recording medium 32 is formed between the nozzle electrode (nozzle plate 24) and the rear surface electrode 34. The solid arrows drawn between the electrodes 24 and 34 provide a schematic representation of the electric flux lines.

The formation of the convergence electrode receding surface 25A in the flared shape around the opening of the nozzle 12 causes the space potential of the region indicated by A in FIG. 3 (the electric field region corresponding to the region of the opening of the nozzle 12) to be lower than the space potential of the region indicated by B in FIG. 3 (the electric field region corresponding to the region of the convergence electrode external surface 24A). This difference in space potential and the resulting nonuniform electric field cause the charged mist of ink micro-particles 42 to be converged toward the point Px, at which the center axis $C_{NZ}$ of the nozzle 12 intersects with the recording medium 32 (the point directly above the hole of the nozzle 12 in FIG. 3).

The dots recorded on the recording medium 32 can thereby be prevented from expanding in diameter, making high-precision image recording possible.

Specific numerical values related to the thickness $h_0$ of the nozzle plate 24, such as the nozzle length $h_1$, the depth $h_2$ of the recess 25, the taper angle $\theta_{NZ}$ of the inner surface 12A of the nozzle 12, and the nozzle diameter $D_{NZ}$ (the diameter of the narrowest part of the nozzle 12), are set to appropriate values according to their relationship to the distance from the rear surface electrode 34, the applied voltage, the recording resolution, and other such various set conditions.

If a power source having a controllable voltage output (for example, a multi-output power source) is used as the charging and accelerating power source 36, it is then possible to temporally separate the charging function (to apply the charging voltage) and the accelerating function (to apply the accelerating voltage) of the charging and accelerating power source 36, by temporally switching the voltages applied to the nozzle electrode (nozzle plate 24).

Second Embodiment

Figure 4:
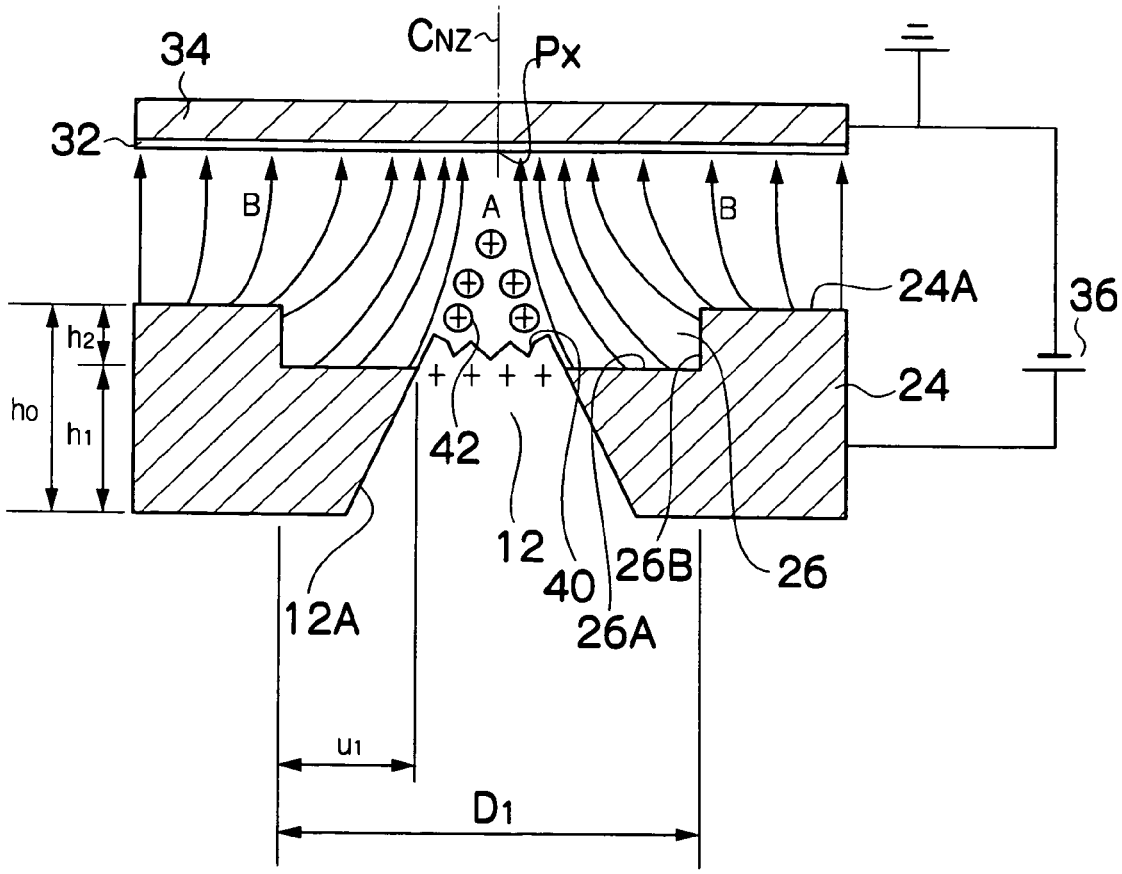
FIG. 4 is an enlarged schematic drawing showing the principal composition of a second embodiment of the present invention.

FIG. 4 is an enlarged diagram showing essential parts of the mist spraying apparatus according to a second embodiment of the present invention. Elements in FIG. 4 that are identical or similar to the configuration shown in FIG. 3 are denoted with the same reference symbols, and descriptions thereof are omitted.

In FIG. 3, the embodiment has been described wherein the flared recess 25 is formed on the ejection surface side of the nozzle plate 24. In the embodiment shown in FIG. 4, a stepped recess 26 having a flat bottom surface 26A and a vertical inner surface 26B is formed on the ejection surface side of the nozzle plate 24 instead of the flared recess 25. The uneven (unflat) electrode surface that is composed of the bottom surface 26A and the inner surface 26B of the recess 26 and the flat area 24A around the recess 26 functions as the convergence and acceleration electrode (the second electrode). The nozzle electrode configuration shown in FIG. 4 can be easily created by electroforming as an overhanging structure.

According to the configuration in FIG. 4, the space potential of the region indicated by A in FIG. 4 (the electric field region corresponding to the region of the opening of the nozzle 12) is made to be lower than the space potential of the region indicated by B in FIG. 4 (the electric field region corresponding to the region of the convergence electrode external surface 24A). This difference in space potential and the resulting nonuniform electric field cause the charged mist of ink micro-particles 42 to be converged toward the point Px, at which the center axis $C_{NZ}$ of the nozzle 12 intersects with the recording medium 32 (the point directly above the hole of the nozzle 12 in FIG. 4).

The dots recorded on the recording medium 32 can thereby be prevented from expanding in diameter, making high-precision image recording possible.

Specific numerical values in the structure shown in FIG. 4, such as the diameter $D_1$ of the recess 26, and the distance $u_1$ from the edge of the opening of the nozzle 12 to the vertical surface 26B in the radial direction of the recess 26 (i.e., the length of the flat bottom surface 26A in the radial direction), are set to appropriate values according to their relationship to the distance from the rear surface electrode 34, the applied voltage, the recording resolution, and other such various set conditions.

Third Embodiment

Figure 5:
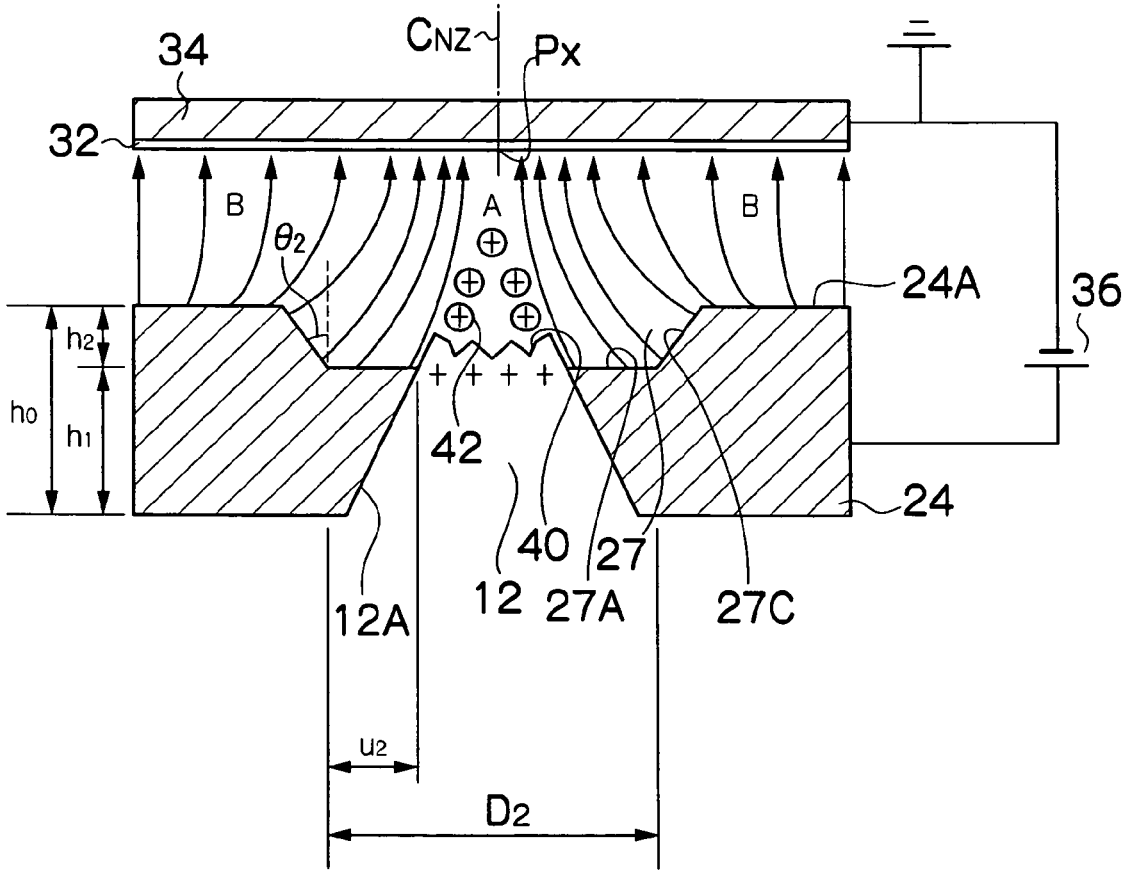
FIG. 5 is an enlarged schematic drawing showing the principal composition of a third embodiment of the present invention.

FIG. 5 is an enlarged diagram showing essential parts of the mist spraying apparatus according to a third embodiment of the present invention. Elements in FIG. 5 that are identical or similar to the configurations shown in FIGS. 3 and 4 are denoted with the same reference symbols, and descriptions thereof are omitted.

In FIG. 4, the embodiment has been described wherein the stepped recess 26 having the flat bottom surface 26A and the vertical inner surface 26B is formed on the ejection surface side of the nozzle plate 24. In the embodiment shown in FIG. 5, a recess 27 having a flat bottom surface 27A and an inclined surface (flared inner surface) 27C is formed on the ejection surface side of the nozzle plate 24 instead of the stepped recess 26. The uneven (unflat) electrode surface that is composed of the bottom surface 27A and the inclined surface 27C of the recess 27 and the flat area 24A around the recess 27 functions as the convergence and acceleration electrode (the second electrode).

According to the configuration in FIG. 5, the space potential of the region indicated by A in FIG. 5 (the electric field region corresponding to the region of the opening of the nozzle 12) is made to be lower than the space potential of the region indicated by B in FIG. 5 (the electric field region corresponding to the region of the convergence electrode external surface 24A). This difference in space potential and the resulting nonuniform electric field cause the charged mist of ink micro-particles 42 to be converged toward the point Px, at which the center axis $C_{NZ}$ of the nozzle 12 intersects with the recording medium 32 (the point directly above the hole of the nozzle 12 in FIG. 5).

The dots recorded on the recording medium 32 can thereby be prevented from expanding in diameter, making high-precision image recording possible.

Specific numerical values in the structure shown in FIG. 5, such as the inner diameter $D_2$ of the recess 27, the distance $u_2$ from the edge of the opening of the nozzle 12 to the inclined surface 27C in the radial direction of the recess 27 (i.e., the length of the flat bottom surface 27A in the radial direction), and the flaring angle $\theta_2$ of the inclined surface 26C are set to appropriate values according to their relationship to the distance from the rear surface electrode 34, the applied voltage, the recording resolution, and other such various set conditions.

Fourth Embodiment

Figure 6:
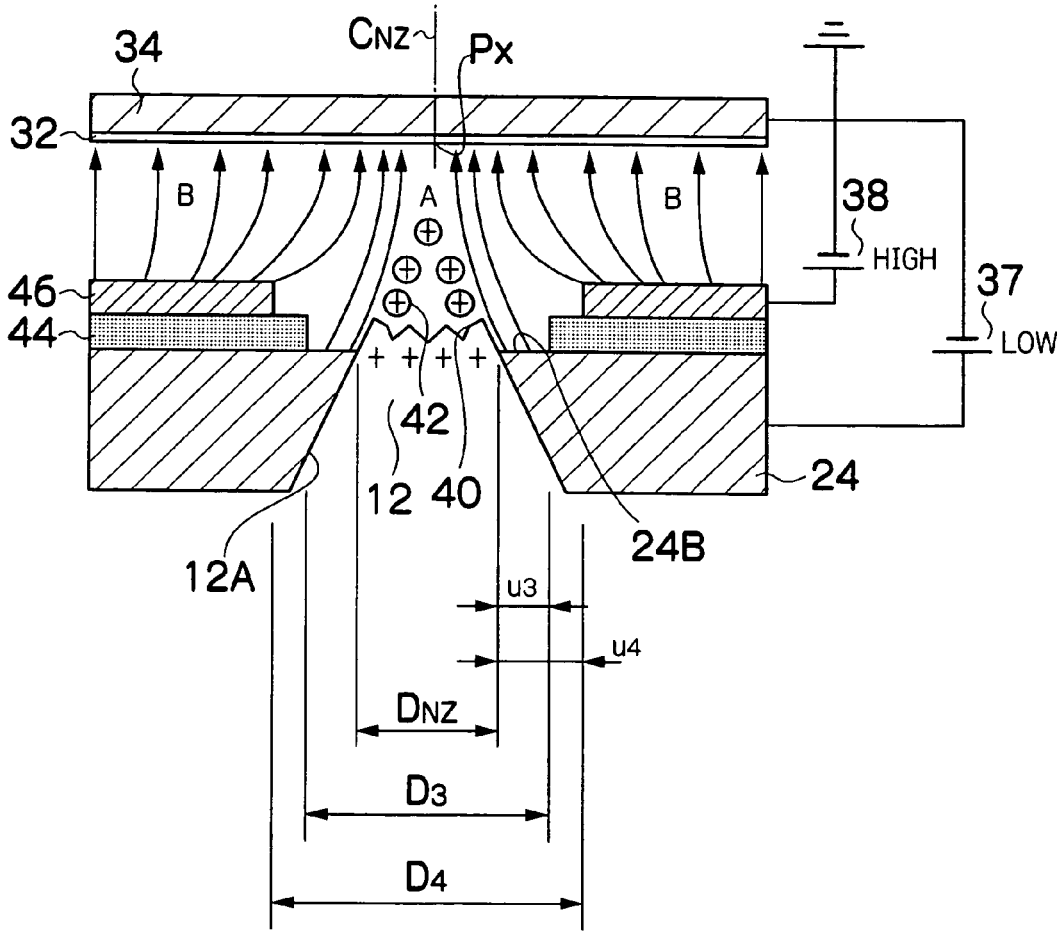
FIG. 6 is an enlarged schematic drawing showing the principal composition of a fourth embodiment of the present invention.

FIG. 6 is an enlarged diagram showing essential parts of the mist spraying apparatus according to a fourth embodiment. Elements in FIG. 6 that are identical or similar to the configuration shown in FIG. 3 are denoted with the same reference symbols, and descriptions thereof are omitted.

In the fourth embodiment shown in FIG. 6, the electric field having the effects of accelerating and converging the mist is created using a laminated nozzle electrode. More specifically, an insulating film 44 and an electrode film 46 are arranged to form steps on the ejection side surface of the nozzle plate 24 (reverse to the surface adjacent to the ink chamber 14; namely, the upper side in FIG. 1). The nozzle plate 24, which is a first nozzle electrode member, serves as a first layer electrode, and the electrode film 46, which is a second nozzle electrode member, serves as a second layer electrode.

On the ink ejection side surface of the nozzle plate 24 (the upper surface in FIG. 6), the insulating film 44 is formed around the opening of the nozzle 12, separated from the edge of the opening of the nozzle 12 by a prescribed distance of $u_3$ in an outward radial direction.

The insulating film 44 is not formed over a region 24B on the nozzle plate 24 inside the prescribed distance $u_3$ from the edge of the opening of the nozzle 12 in the plane of the nozzle plate 24, and the surface of the nozzle plate 24 (the electrode surface of the first layer electrode) is exposed in the region 24B. The second layer electrode 46 is provided on the insulating film 44. The second layer electrode 46 is formed separated from the edge of the opening of the nozzle 12 by a prescribed distance of $u_4$ (where $u_3<u_4$) in an outward radial direction in the plane of the nozzle plate 24.

In other words, the opening section of the insulating film 44 (region where there is no insulating film 44) and the opening section of the second layer electrode 46 (region where there is no second layer electrode 46) are formed concentrically about the center of the opening of the nozzle 12, and taking the diameter of the opening of the nozzle 12 to be $D_{NZ}$, the diameter of the opening of the insulating film 44 to be $D_3$, and the diameter of the opening of the second layer electrode 46 to be $D_4$, the relationship $D_{NZ}<D_3<D_4$ is satisfied.

Specific numerical values of the prescribed distances $U_3$ and $u_4$ are set to appropriate levels in accordance with their relationship to the nozzle diameter, the nozzle pitch, the distance from the rear surface electrode 34, the applied voltage, and other such various set conditions.

As shown in FIG. 6, the positive pole of a first power source 37 (a first voltage application device) is connected to the first layer electrode (nozzle plate 24), and a relatively low direct current voltage V1 (first voltage) is applied to same. The positive pole of a second power source 38 (a second voltage application device) is connected to the second layer electrode 46, and a relatively high direct current voltage V2 (second voltage, where V1<V2) is applied to same.

Thereby, the second layer electrode 46 is applied with the potential higher than the potential of the first layer electrode (the nozzle plate 24), so that the space potential of the region indicated by A in FIG. 6 (the electric field region corresponding to the region of the opening of the nozzle 12) is made to be lower than the space potential of the region indicated by B in FIG. 6 (the electric field region corresponding to the region of the second layer electrode 46).

This difference in space potential and the resulting nonuniform electric field cause the charged mist of ink micro-particles 42 to be converged toward the point Px, at which the center axis $C_{NZ}$ of the nozzle 12 intersects with the recording medium 32 (the point directly above the hole of the nozzle 12 in FIG. 6).

The dots recorded on the recording medium 32 can thereby be prevented from expanding in diameter, making high-precision image recording possible.

Figure 7:
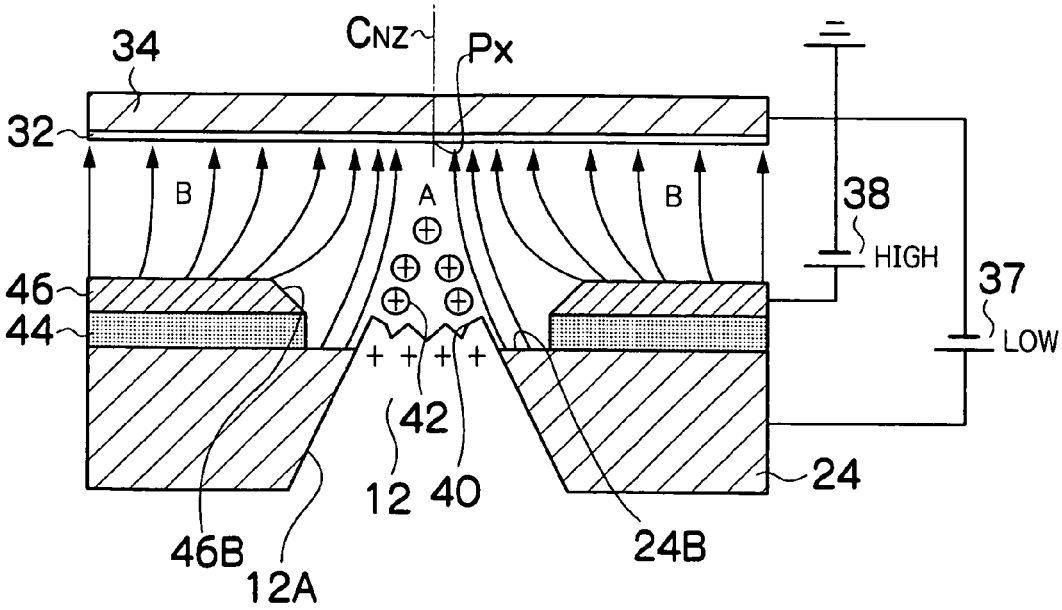
FIG. 7 is an enlarged schematic drawing showing the principal composition of a modification of the configuration shown in FIG. 6.

FIG. 7 shows a modification of the configuration shown in FIG. 6, in which an inner end surface 46B of the second layer electrode 46 is formed into a flared shape. Elements in FIG. 7 that are identical or similar to the configuration shown in FIG. 6 are denoted with the same reference symbols, and descriptions thereof are omitted.

The configuration shown in FIG. 7 can be formed by etching, in a case where the second layer electrode 46 is made of silicon (Si) and the insulating film 44 is made of silicon dioxide ($SiO_2$).

Fifth Embodiment

Figures 8, 9:
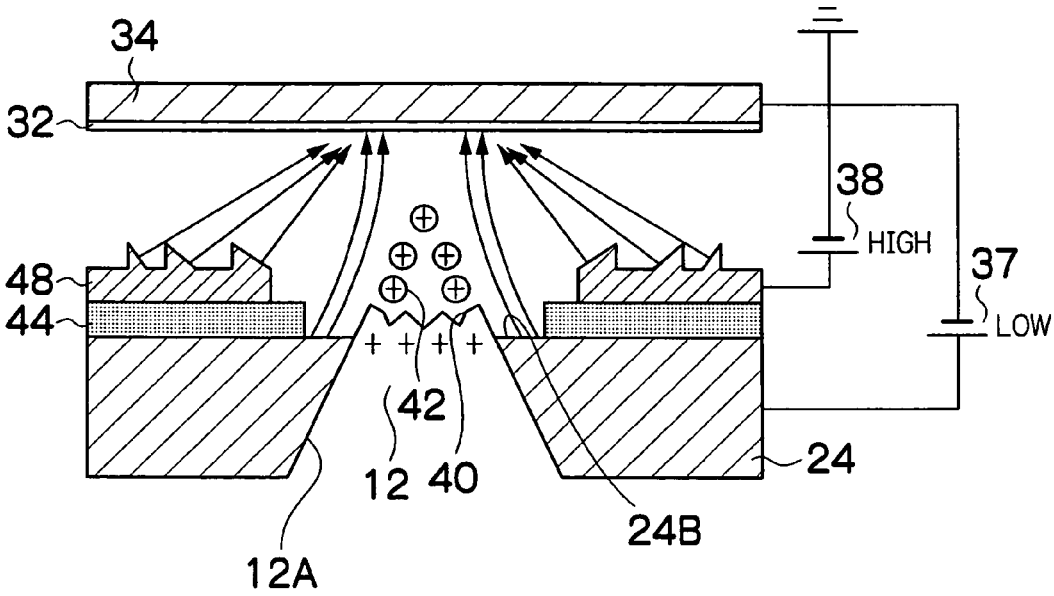
FIG. 8 is an enlarged schematic drawing showing the principal composition of a fifth embodiment of the present invention.
FIG. 9 is a table of the numerical values of the parameters used to calculate space potential.

FIG. 8 is an enlarged diagram showing essential parts of the mist spraying apparatus according to a fifth embodiment. Elements in FIG. 8 that are identical or similar to the configuration shown in FIG. 6 are denoted with the same reference symbols, and descriptions thereof are omitted.

Instead of the second layer electrode 46 in FIG. 6, a Fresnel electromagnetic lens 48 is provided on the insulating film 44 in the embodiment in FIG. 8. In implementing the present invention, the electromagnetic lens is not limited to a Fresnel lens, and can also be a spherical electromagnetic lens or an electromagnetic lens of any other shape. The charged mist can be converged more efficiently by using an electromagnetic lens such as the Fresnel electromagnetic lens 48 or a spherical electromagnetic lens.

CALCULATION EXAMPLE

Generally, the space potential is calculated by the following Poisson's equation:

$$\Delta\phi=-(\rho/\epsilon),$$

where $\phi$ is electric potential, $\rho$ is charge density, $\epsilon$ is a dielectric constant, and $\Delta$ is the Laplace operator (Laplacian). Solving this equation by appropriately assigning $\rho$ and $\epsilon$ to space, and using, for example, the Gauss-Seidel method or another such method of numerical analysis, gives the electric potential distribution for an arbitrary space charge density distribution and space dielectric constant distribution. If the electric potential distribution is determined, then the electric field is expressed by the following equation:

$$E=-\nabla\phi,$$

where E is the electric field, and $\nabla$ is the del operator.

Figure 10:
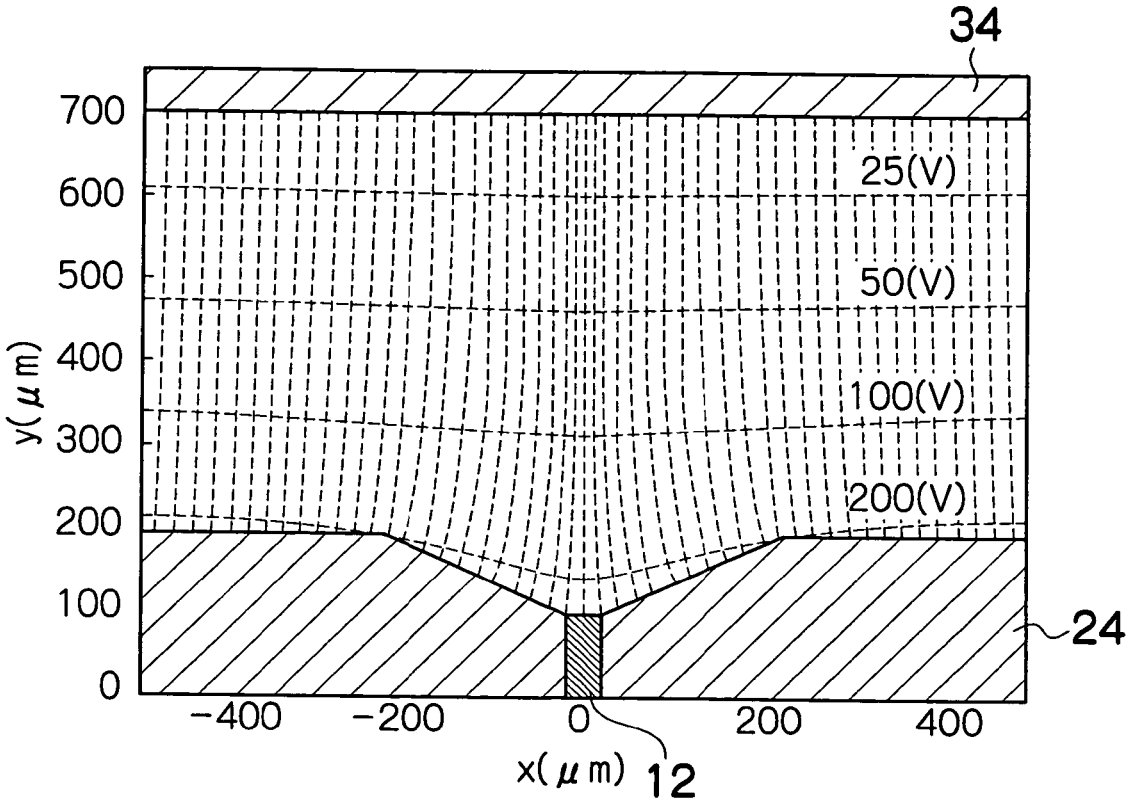
FIG. 10 is a diagram showing the electric flux lines of electric fields calculated under certain set conditions in a configuration that resembles the configuration described in the first embodiment.

FIG. 10 shows the electric potentials and the electric flux lines obtained by tracing the electric potential gradients when setting the starting points at regular intervals in the horizontal direction by calculating with the parameters shown in FIG. 9, in the case of a configuration resembling the configuration described in the first embodiment, in which the tapered nozzle 12 in the first embodiment is replaced with a straight nozzle.

The reference numerals 12, 24 and 34 in FIG. 10 denote correspondence with the structural elements described with reference to FIG. 3. In FIG. 10, the hatched part denoted with the reference numeral 24 is the nozzle electrode region, the part denoted with the reference numeral 12 is the nozzle, the densely hatched part in the nozzle is the ink region, and the hatched part denoted with the reference numeral 34 is the region of the electrode (rear surface electrode) opposite to the nozzle electrode at a distance of 500 μm. The nozzle electrode surface is assumed to have the potential of about 200 V, and the opposite electrode is assumed to be grounded. FIG. 10 approximately shows the equipotential planes (lines) of the potentials of 200 V, 100 V, 50 V and 25 V.

For the sake of convenience in the calculation, the electrodes are considered to have the properties of polyethylene (dielectric material) instead of metal, but the settings can be established without any particular obstacles as long as the calculated space potential is within an achievable range. The charge density of the ink region is assumed to be the same as that of the electrode, assuming the worst possible conditions. The dielectric constant of water is used for that of the ink.

It can be seen from FIG. 10 that the convergence effects can be achieved by merely using the appropriate spatial shape of the nozzle electrode (by forming the flared recess around the nozzle 12), even under the above-described conditions.

In order to prevent the electric flux lines from being drawn into the nozzle 12 under the above-described conditions, the flared angle of the convergence electrode surface around the nozzle 12 is preferably 60 degrees or more; however, this condition does not apply to the case of a configuration in which the convergence electrode protrudes from a position separated from the opening of the nozzle 12, as shown in FIG. 5.

Structural Embodiment of Image Forming Apparatus

Next, an embodiment of an image forming apparatus, which employs the mist spraying apparatus described above as a print head, is described.

Figure 11:
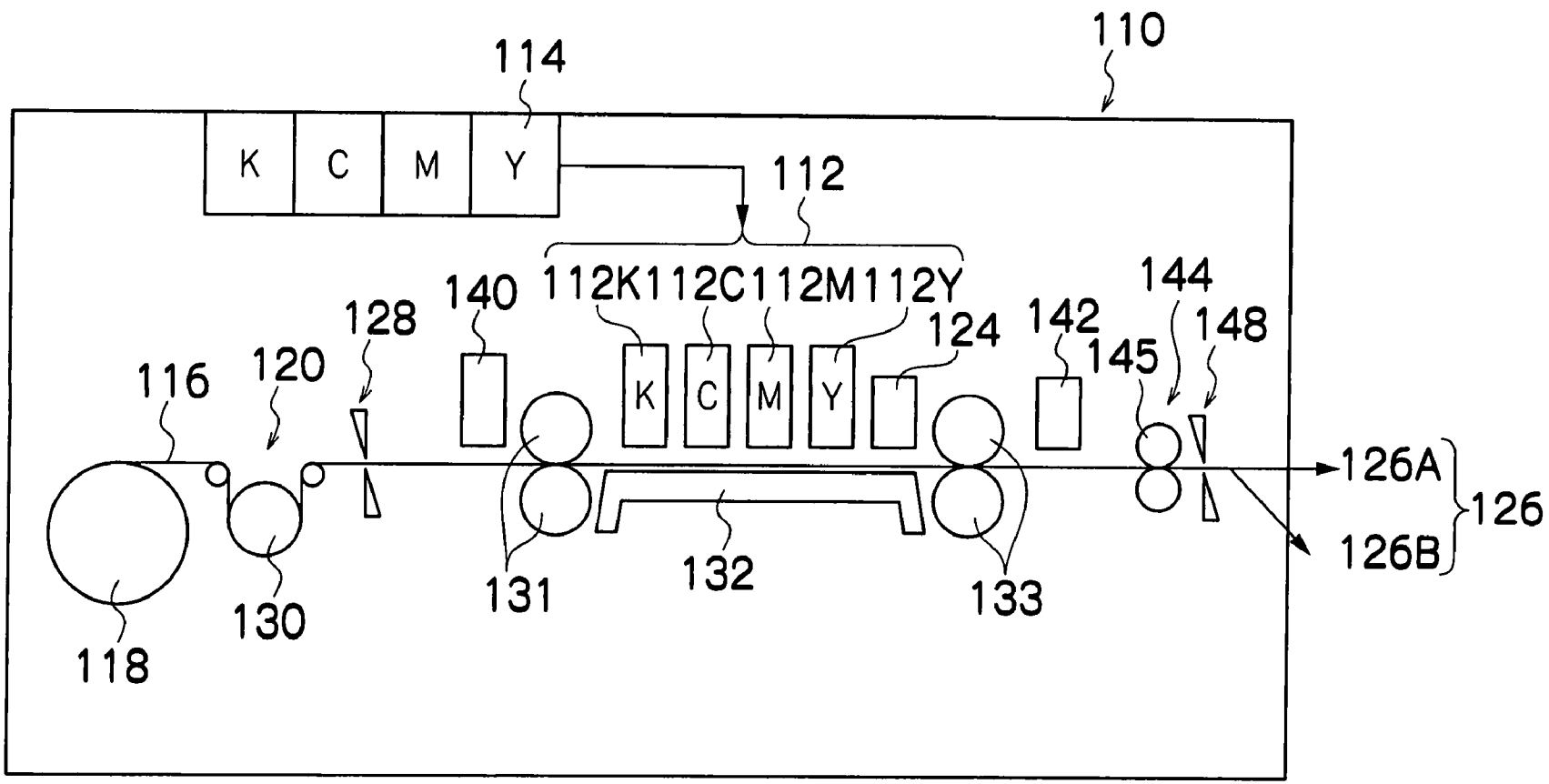
FIG. 11 is a general schematic drawing of an inkjet recording apparatus showing one embodiment of an image forming apparatus according to the present invention.

FIG. 11 is a general configuration diagram of an inkjet recording apparatus according to an embodiment of an image forming apparatus of the present invention. As shown in FIG. 11, the inkjet recording apparatus 110 comprises: a printing unit 112 having a plurality of mist ejection heads (hereafter, called "heads") 112K, 112C, 112M, and 112Y provided for ink colors of black (K), cyan (C), magenta (M), and yellow (Y), respectively; an ink storing and loading unit 114 for storing inks of K, C, M and Y to be supplied to the heads 112K, 112C, 112M, and 112Y; a paper supply unit 118 for supplying recording paper 116 which is a recording medium; a decurling unit 120 removing curl in the recording paper 116; a belt conveyance unit 122 disposed facing the nozzle face (ink-droplet ejection face) of the printing unit 112, for conveying the recording paper 116 while keeping the recording paper 116 flat; a print determination unit 124 for reading the printed result produced by the printing unit 112; and a paper output unit 126 for outputting image-printed recording paper (printed matter) to the exterior.

The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 11, a magazine for rolled paper (continuous paper) is shown as an embodiment of the paper supply unit 118;

however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording media can be used, it is preferable that an information recording medium such as a bar code and a wireless tag containing information about the type of medium is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 11, and the continuous paper is cut into a desired size by the cutter 128. When cut papers are used, the cutter 128 is not required.

After decurling, the cut recording paper 116 is nipped and conveyed by the pair of conveyance rollers 131, and is supplied onto the platen 132. A pair of conveyance rollers 133 is also disposed on the downstream side of the platen 132 (the downstream side of the print unit 112), and the recording paper 116 is conveyed at a prescribed speed by the joint action of the front side pair of conveyance rollers 131 and the rear side pair of conveyance rollers 133.

The platen 132 functions as a member which holds (supports) the recording paper 116 while keeping the recording paper 116 flat (a recording medium holding device), as well as being a member which functions as the rear surface electrode 34 described with reference to FIG. 1 and the like. The platen 132 in FIG. 11 has a width dimension which is greater than the width of the recording paper 116, and at least the portion of the platen 132 opposing the nozzle surface of the print unit 112 and the sensor surface of the print determination unit 124 is a horizontal surface (flat surface).

A heating fan 140 is disposed on the upstream side of the printing unit 112 in the conveyance pathway of the recording paper 116. The heating fan 140 blows heated air onto the recording paper 116 to heat the recording paper 116 immediately before printing so that the ink deposited on the recording paper 116 dries more easily.

Figure 12:
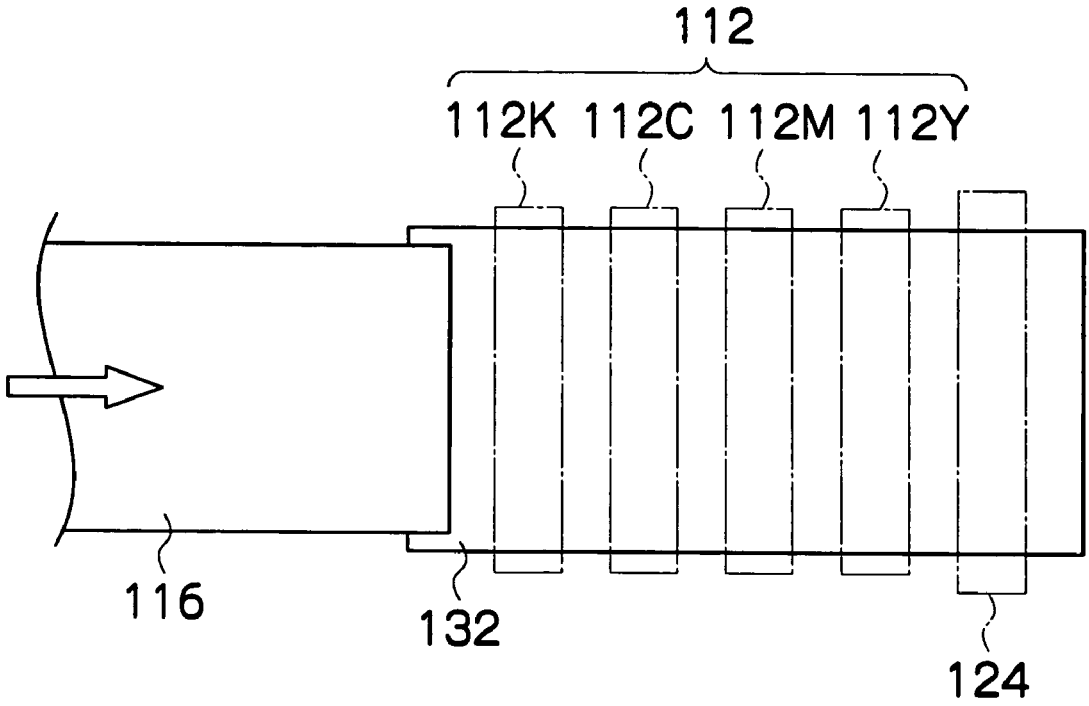
FIG. 12 is a principal plan diagram of the peripheral area of a print unit in the inkjet recording apparatus illustrated in FIG. 11.

The heads 112K, 112C, 112M and 112Y of the printing unit 112 are full line heads having a length corresponding to the maximum width of the recording paper 116 used with the inkjet recording apparatus 110, and comprising a plurality of nozzles for ejecting ink arranged on the nozzle face through a length exceeding at least one edge of the maximum-size recording paper (namely, the full width of the printable range) (see FIG. 12).

The heads 112K, 112C, 112M and 112Y are arranged in color order of black (K), cyan (C), magenta (M), yellow (Y) from the upstream side in the feed direction of the recording paper 116, and these heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively, onto the recording paper 116 while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which heads for ejecting light-colored inks such as light cyan and light magenta are added. Furthermore, there are no particular restrictions of the sequence in which the heads of respective colors are arranged.

The print determination unit 124 illustrated in FIG. 11 has an image sensor (line sensor or area sensor) for capturing an image of the droplet ejection result of the print unit 112, and functions as a device to check for ejection defects such as blockages, landing position displacement, and the like, of the nozzles from the image of deposited droplets read in by the image sensor. A test pattern or the target image printed by the heads 112K, 112C, 112M, and 112Y of the respective colors is read in by the print determination unit 124, and the ejection performed by each head is determined. The ejection determination includes the presence of the ejection, measurement of the dot size, and measurement of the dot landing position.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 11, the paper output unit 126A for the target prints is provided with a sorter for collecting prints according to print orders.

Structure of Head

Next, the structure of the head is described. The heads 112K, 112C, 112M and 112Y of the respective ink colors have the same structure, and a reference numeral 150 is hereinafter designated to any of the heads.

Figure 13:
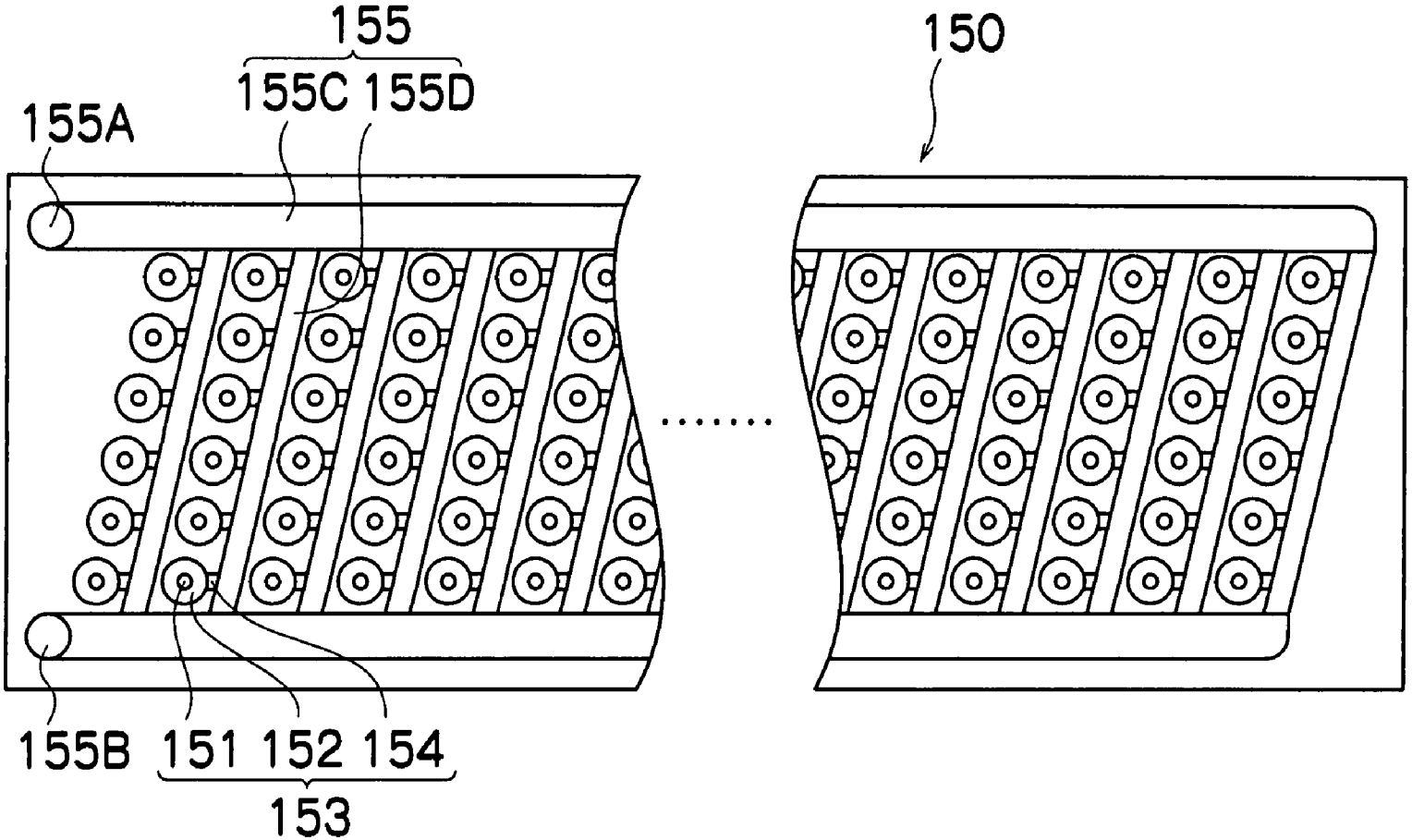
FIG. 13 is a plan view perspective diagram showing the internal structure of a print head.

FIG. 13 is a plan view perspective diagram showing the internal structure of the head 150. In order to achieve a high resolution (small pitch) of the dots printed onto the surface of the recording paper 116, it is necessary to achieve a high density (small pitch) of the nozzles in the head 150. As shown in FIG. 13, the head 150 according to the present embodiment has a structure in which a plurality of ink chamber units (liquid droplet ejection elements) 153, each having a nozzle 151 forming an ink ejection port, an ink chamber 152 corresponding to the nozzle 151, and the like, are disposed (two-dimensionally) in the form of a staggered matrix, and hence the effective nozzle interval (the projected nozzle pitch) as projected in the lengthwise direction of the head (the direction perpendicular to the paper conveyance direction) is reduced (high nozzle density is achieved). In FIG. 13, in order to simplify the drawing, the number of channels (number of ink chamber units 153) is omitted from the drawing.

The ink chambers 152 of the respective channels are connected to a common flow channel 155 through individual supply paths 154. The common flow channel 155 is connected to an ink tank which forms an ink source (not shown in FIG. 13 and equivalent to the ink storing and loading unit 114 shown in FIG. 11), through connection ports 155A and 155B, and the ink supplied from the ink tank is distributed and supplied to the ink chambers 152 of the respective channels through the common flow channel 155 in FIG. 13. The reference numeral 155C in FIG. 13 indicates a main channel of the common flow channel 155 and 155D indicates a distributary channel which branches off from the main channel 155C.

To give a brief description of the correspondence of the head 150 shown in FIG. 13 to the composition shown in FIGS. 1 to 8, the nozzles 151, the ink chambers 152 and the individual supply paths 154 in FIG. 13 correspond respectively to the nozzles 12, the ink chambers 14 and the ink supply ports 16 shown in FIGS. 1 to 8. Furthermore, the distributary channels 155D of the common flow channel 155 in FIG. 13 correspond to the common flow channel 18 shown in FIG. 1.

The detailed structure of the respective ink chamber units 153 in FIG. 13 is similar to that described with reference to FIGS. I to 8. FIGS. 1 and 2 show a structure in which the piezoelectric body 22A and the individual electrode 22C constituting the piezoelectric element 22 are separated into independent element units, but it is also possible to adopt a structure in which a piezoelectric body layer is formed integrally (as a single plate), without being separated into element units, and the individual electrodes are separated (by patterning into element units), in such a manner that a plurality of piezoelectric elements are formed which respectively use the regions of the piezoelectric body in the areas of their individual electrodes as active sections.

Figure 14:
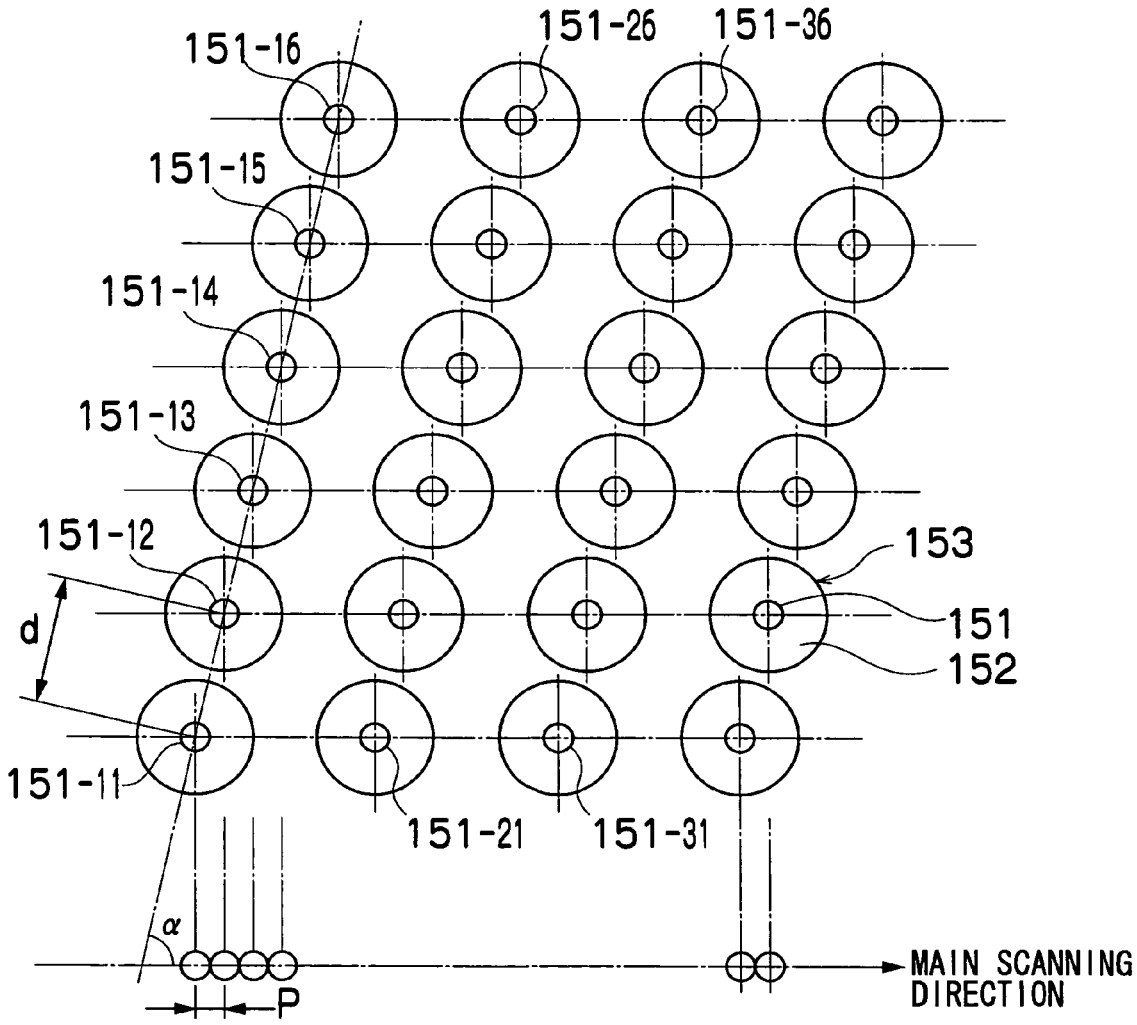
FIG. 14 is an enlarged diagram of the structural arrangement of ink chamber units in the head shown in FIG. 13.

FIG. 14 is an enlarged diagram of the structural arrangement of the ink chamber units 153 in the head 150 shown in FIG. 13. As shown in FIG. 14, the high-density nozzle head according to the present embodiment is achieved by arranging a plurality of ink chamber units 153 in a lattice fashion based on a fixed arrangement pattern, in a row direction which coincides with the main scanning direction, and a column direction which is inclined at a fixed angle of a with respect to the main scanning direction, rather than being perpendicular to the main scanning direction.

More specifically, by adopting a structure in which a plurality of ink chamber units 153 are arranged at a uniform pitch d in line with a direction forming the angle of a with respect to the main scanning direction, the pitch P of the nozzles projected so as to align in the main scanning direction is d $\times\cos\alpha$, and hence the nozzles 151 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that shown in FIG. 14 are driven, the main scanning according to the above-described (3) is preferred. More specifically, the nozzles 151-11, 151-12, 151-13, 151-14, 151-15 and 151-16 are treated as a block (additionally; the nozzles 151-21, . . . , 151-26 are treated as another block; the nozzles 151-31, . . . , 151-36 are treated as another block; . . . ); and one line is printed in the width direction of the recording paper 116 by sequentially driving the nozzles 151-11, 151-12, . . . , 151-16 in accordance with the conveyance velocity of the recording paper 116.

On the other hand, "sub-scanning" is defined as to repeatedly perform printing of one line (a line formed of a row of dots, or a line formed of a plurality of rows of dots) formed by the main scanning, while moving the full-line head and the recording paper 116 relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording paper 116 is called the sub-scanning direction and the direction perpendicular to same is called the main scanning direction.

Figure 15:
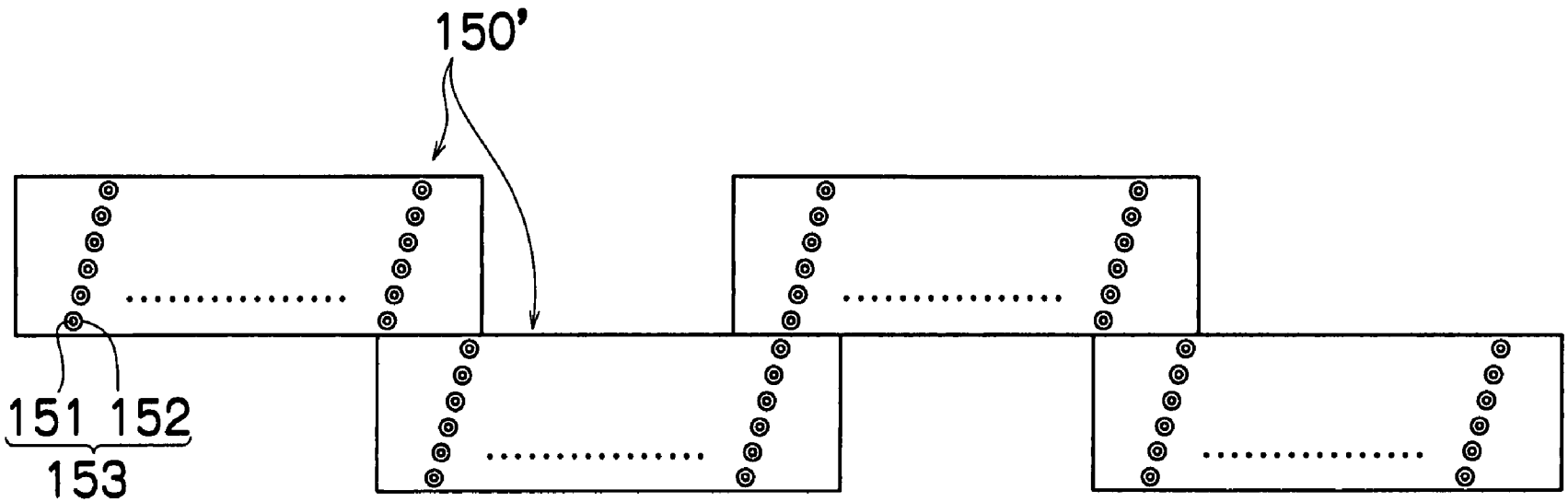
FIG. 15 is a plan view perspective diagram showing a further embodiment of the composition of a full line head.

In implementing the present invention, the nozzle arrangement structure is not limited to the embodiment shown in FIGS. 13 and 14. For example, in one mode of a full line head which has a nozzle row extending through a length corresponding to the full width of the recording paper 116 in a direction substantially perpendicular to the conveyance direction of the recording paper 116, instead of the composition shown in FIG. 13, it is possible to compose a line head having a nozzle row of a length corresponding to the full width of the recording paper 116 by joining together, in a staggered matrix arrangement, a plurality of short head blocks 150', each comprising a plurality of nozzles 151 arranged in a two-dimensional configuration, as shown in FIG. 15.

Description of Control System

Figure 16:
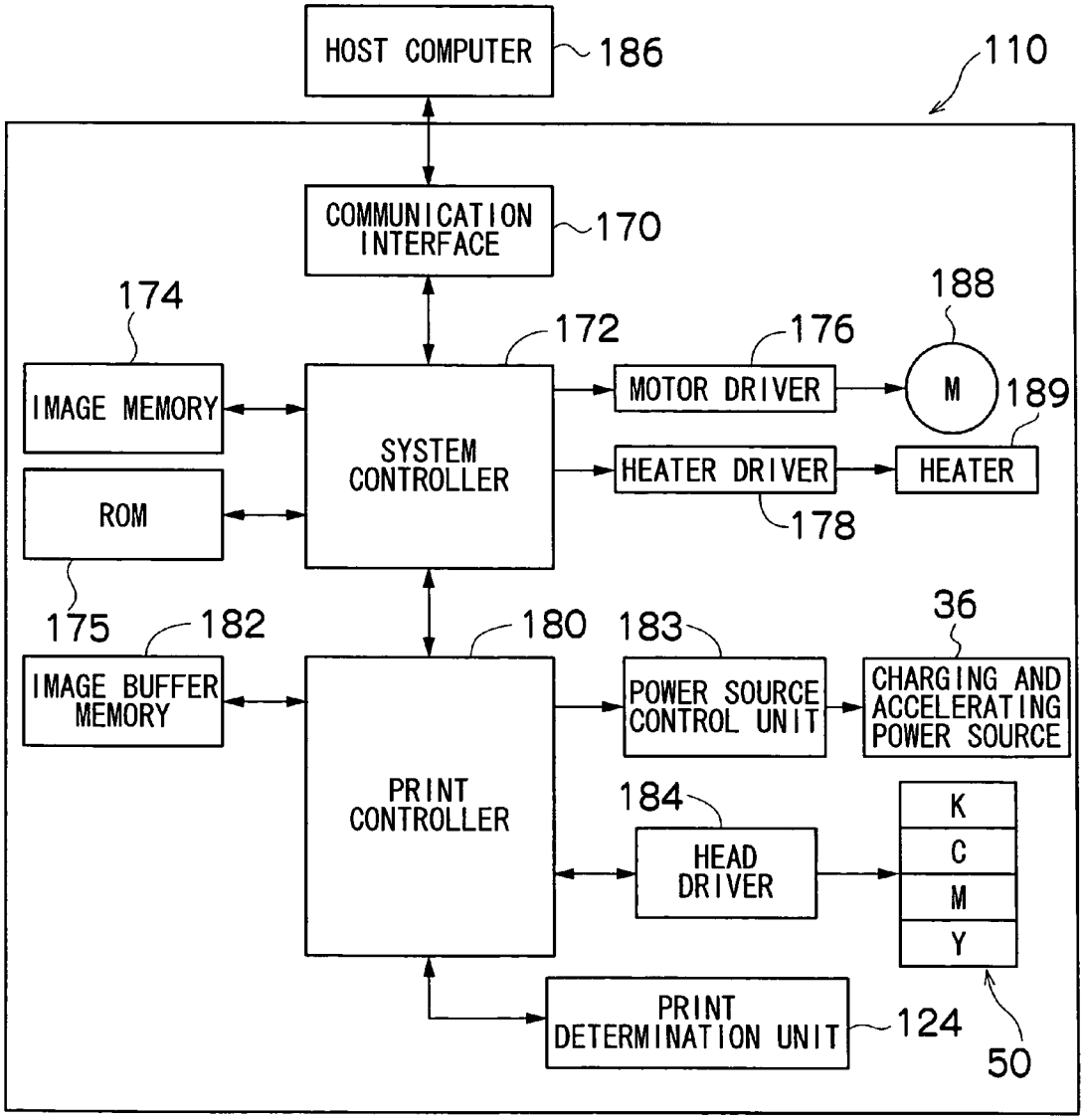
FIG. 16 is a principal block diagram showing the system composition of an inkjet recording apparatus according to the present embodiment.

FIG. 16 is a block diagram showing the system configuration embodiment of the inkjet recording apparatus 110. In the configuration shown in FIG. 16, the heads according to the embodiment described in FIGS. 1 to 5 (wherein the nonuniform electric field is formed based on the shape of the nozzle electrode having the recess formed around the nozzle opening). As shown in FIG. 16, the inkjet recording apparatus 110 comprises a communication interface 170, a system controller 172, an image memory 174, a ROM 175, a motor driver 176, a heater driver 178, a print controller 180, an image buffer memory 182, a power source control unit 183, a head driver 184, and the like.

The communication interface 170 is an interface unit (image input device) for receiving image data sent from a host computer 186. A serial interface such as USB, IEEE1394, Ethernet, wireless network, or a parallel interface such as a Centronics interface may be used as the communication interface 170. A buffer memory (not shown) may be mounted in this portion in order to increase the communication speed.

The image data sent from the host computer 186 is received by the inkjet recording apparatus 110 through the communication interface 170, and is temporarily stored in the image memory 174. The image memory 174 is a storage device for storing images inputted through the communication interface 170, and data is written and read to and from the image memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 172 controls the various sections, such as the communication interface 170, image memory 174, motor driver 176, heater driver 178, and the like, as well as controlling communications with the host computer 186 and writing and reading to and from the image memory 174 and ROM 175, and it also generates control signals for controlling the motor 188 and heater 189 of the conveyance system. The motor 188 of the conveyance system is a motor which applies a drive force to the drive rollers of the pairs of conveyance rollers 131 and 133 shown in FIG. 11, for example. Furthermore, the heater 189 in FIG. 16 is a heating device which is used in the heating drum 130, heating fan 140 or post drying unit 142, as shown in FIG. 11.

The program executed by the CPU of the system controller 172 and the various types of data which are required for control procedures are stored in the ROM 175. The ROM 175 may be a non-writeable storage device, or it may be a rewriteable storage device, such as an EEPROM. The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver (drive circuit) 178 drives the heater 189 in accordance with commands from the system controller 172.

The print controller 180 functions as a signal processing device which generates dot data for the inks of respective colors on the basis of the input image. More specifically, the print controller 180 is a control unit which performs various treatment processes, corrections, and the like, in accordance with the control implemented by the system controller 172, in order to generate a signal for controlling ink droplet ejection, from the image data in the image memory 174, and it supplies the print data (dot data) thus generated to the head driver 184.

The image buffer memory 182 is provided in the print controller 180, and image data, parameters, and other data are temporarily stored in the image buffer memory 182 when the image is processed in the print controller 180. FIG. 16 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

The power source control unit 183 is constituted by a control circuit which controls the on/off switching and the output voltage of the charging and accelerating power source 36 (see FIGS. 3 to 5). The power source control unit 183 controls the output of the charging and accelerating power source 36 in accordance with commands from the print controller 180.

To give a general description of the sequence of processing from image input to print output, image data to be printed (original image data) is input from an external source through a communications interface 170, and is accumulated in the image memory 174. At this stage, RGB image data is stored in the image memory 174, for example.

In this inkjet recording apparatus 110, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 174 is sent to the print controller 180 through the system controller 172, and is converted to the dot data for each ink color by a half-toning technique, using dithering, error diffusion, or the like, in the print controller 180.

In other words, the print controller 180 performs processing for converting the input RGB image data into dot data for the four colors of K, C, M and Y. In this way, the dot data generated by the print controller 180 is stored in the image buffer memory 182.

The head driver 184 outputs drive signals for driving the piezoelectric elements 22 corresponding to the respective nozzles 151 of the head 150, on the basis of the ink dot data supplied by the print controller 180 (in other words, the ink dot data stored in the image buffer memory 182). In other words, the combination of the print controller 180 and the head driver 184 functions as a device corresponding to the "drive control device" of the present invention. A feedback control system for maintain uniform driving conditions in the head may also be incorporated into the head driver 184.

The prescribed voltage is applied from the charging and accelerating power source 36 to the nozzle electrode of the head 150 (the nozzle plate 24 shown in FIGS. 1 to 5), and the drive signals outputted from the head driver 184 are applied to the head 150, whereby an ink mist is ejected from the corresponding nozzles 151. By controlling ink ejection from the head 150 in synchronization with the conveyance speed of the recording paper 116, an image is formed on the recording paper 116.

As described above, the ejection volume and the ejection timing of the liquid droplets from the head 150 are controlled, on the basis of the dot data generated by implementing prescribed signal processing in the print controller 180. By this means, prescribed dot size and dot positions can be achieved.

The print determination unit 124 is a block that includes the image sensor as described above with reference to FIG. 11, reads the image printed on the recording paper 116, determines the print conditions (presence of the ejection, variation in the dot formation, optical density, and the like) by performing desired signal processing, or the like, and provides the determination results of the print conditions to the print controller 180. Instead of or in conjunction with this print determination unit 124, it is also possible to provide another ejection determination device (corresponding to an ejection abnormality determination device).

As a further ejection determination device, it is possible to adopt, for example, a mode (internal determination method) in which a pressure sensor is provided inside or in the vicinity of each ink chamber 152 of the head 150, and ejection abnormalities are determined from the determination signals obtained from these pressure sensors when ink is ejected or when the piezoelectric elements are driven in order to measure the pressure. Alternatively, it is also possible to adopt a mode (external determination method) using an optical determination system comprising a light source, such as laser light emitting element, and a photoreceptor element, whereby light, such as laser light, is irradiated onto the ink droplets ejected from the nozzles and the droplets in flight are determined by means of the transmitted light quantity (received light quantity).

The print controller 180 implements various corrections (correction of the ejection volume, correction of the ejection position, and the like), with respect to the head 150, on the basis of the information obtained from the print determination unit 124 or another ejection determination device (not illustrated), according to requirements, and it implements control for carrying out cleaning operations (nozzle restoring operations), such as preliminary ejection, (which may also be called "purging", "dummy ejection", "blank ejection", or the like), nozzle suctioning, or wiping, as and when necessary.

According to the inkjet recording apparatus 110 having the composition described above, it is possible to form dots of a small dot diameter compared to the related art, and hence an image of high resolution can be formed.

Figure 17:
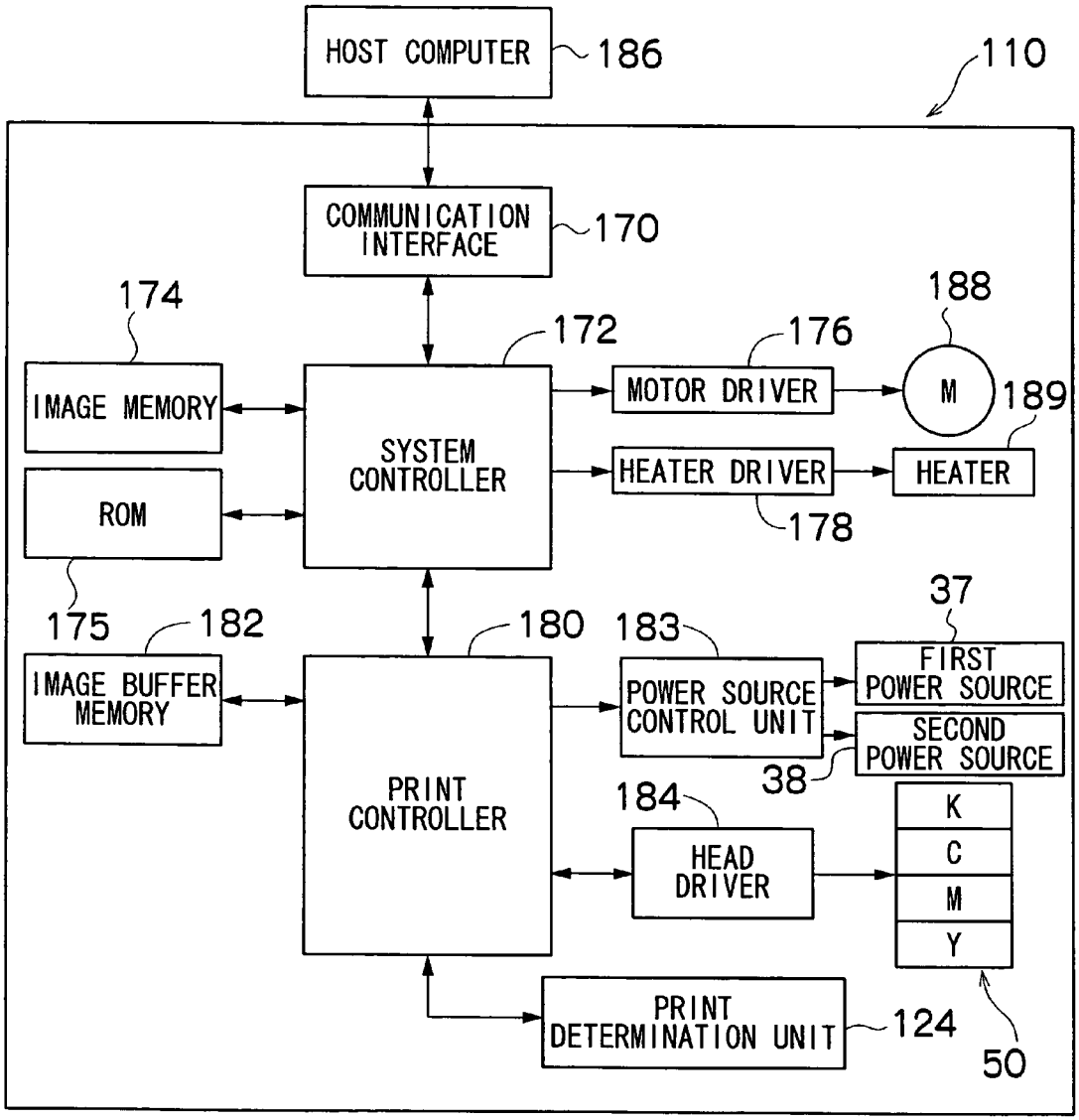
FIG. 17 is a principal block diagram showing the system composition of an inkjet recording apparatus according to another embodiment.

FIG. 17 is a block diagram showing a further embodiment of the system composition of the inkjet recording apparatus 110. In the configuration shown in FIG. 17, the heads according to the embodiment described in FIGS. 6 to 8 (wherein the nonuniform electric field is formed around the nozzle opening by the nozzle electrode of the laminated structure). In FIG. 17, items which are the same as or similar to the composition in FIG. 16 are denoted with the same reference numerals and description thereof is omitted here.

Instead of the charging and accelerating power source 36 in FIG. 16, the present embodiment is provided with the first power source 37 and the second power source 38 (see FIGS. 6 to 8) for applying prescribed voltages to the electrodes of the patterned nozzle electrode as shown in FIG. 17. The power source control unit 183 shown in FIG. 17 is configured including a control circuit for controlling the turning on and off of the first power source 37 and the second power source 38, as well as their output voltage values. The power source control unit 183 controls the outputs of the first power source 37 and the second power source 38 according to instructions from the print controller 180.

With such a configuration, dots can be formed with smaller size than with a conventional configuration, and high-resolution images can be formed.

In the above descriptions, the inkjet recording apparatus has been described as one embodiment of the image forming apparatus, but the scope of application of the present invention is not limited to this. For example, the mist spraying apparatus according to the present invention may also be applied to a photographic image forming apparatus in which developing solution is applied onto a printing paper by means of a non-contact method. Furthermore, the scope of application of the mist spraying apparatus according to the present invention is not limited to an image forming apparatus, and the present invention may also be applied to various other types of apparatuses which spray a processing liquid, chemical solution, or other liquid, toward a liquid receiving medium by means of a mist ejection head (spray head), (such as a painting apparatus, a coating apparatus, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A mist spraying apparatus, comprising:

a liquid chamber into which liquid is filled;

an ejection port through which the liquid is ejected from the liquid chamber;

a first electrode which is in contact with the liquid and charges the liquid;

a vibration generating device which converts the liquid into droplets by applying vibrational energy to the liquid inside the liquid chamber, thereby generating a charged mist;

a rear surface electrode which is disposed so as to oppose an ejection surface including the ejection port, and holds a liquid receiving medium onto which the charged mist is deposited from the ejection port; and a second electrode which is disposed at a position in an outward radial direction from an edge of the ejection port, and generates an electric field between the second electrode and the rear surface electrode, the electric field accelerating and converging the charged mist ejected from the ejection port toward the liquid receiving medium, wherein the charged mist is a cluster of a plurality of fine droplets of the liquid.

2. The mist spraying apparatus as defined in claim 1, further comprising a nozzle plate in which the ejection port is formed, the nozzle plate having a liquid-contacting surface which functions as the first electrode and an uneven surface which functions as the second electrode.

3. The mist spraying apparatus as defined in claim 1, wherein:

the vibration generating device is constituted by a piezoelectric element; and a drive control device is provided to output a drive signal which causes the piezoelectric element to vibrate ultrasonically.

4. An image forming apparatus comprising the mist spraying apparatus as defined in claim 1, which forms an image on the liquid receiving medium by means of the droplets ejected from the ejection port.

5. A mist spraying apparatus, comprising:

a liquid chamber into which liquid is filled;

an ejection port through which the liquid is ejected from the liquid chamber;

a first electrode which is in contact with the liquid and charges the liquid;

a vibration generating device which converts the liquid into droplets by applying vibrational energy to the liquid inside the liquid chamber, thereby generating a charged mist;

a rear surface electrode which is disposed so as to oppose an ejection surface including the ejection port, and holds a liquid receiving medium onto which the charged mist is deposited from the ejection port;

a second electrode which is disposed at a position in an outward radial direction from an edge of the ejection port, and generates an electric field between the second electrode and the rear surface electrode, the electric field accelerating and converging the charged mist ejected from the ejection port toward the liquid receiving medium; and a nozzle plate in which the ejection port is formed, the nozzle plate having a liquid-contacting surface which functions as the first electrode and an uneven surface which functions as the second electrode, wherein:

a flaring recess is formed on the ejection surface of the nozzle plate round the ejection port, a cross-sectional area of the flaring recess gradually increasing from the ejection port along an ejection direction of the liquid; and the uneven surface includes the flaring recess and periphery thereof.

6. A mist spraying apparatus, comprising:

a liquid chamber into which liquid is filled;

an ejection port through which the liquid is ejected from the liquid chamber;

a first electrode which is in contact with the liquid and charges the liquid;

a vibration generating device which converts the liquid into droplets by applying vibrational energy to the liquid inside the liquid chamber, thereby generating a charged mist;

a rear surface electrode which is disposed so as to oppose an ejection surface including the ejection port, and holds a liquid receiving medium onto which the charged mist is deposited from the election port;

a second electrode which is disposed at a position in an outward radial direction from an edge of the ejection port, and generates an electric field between the second electrode and the rear surface electrode, the electric field accelerating and converging the charged mist ejected from the ejection port toward the liquid receiving medium; and a nozzle plate in which the ejection port is formed, the nozzle plate having a liquid-contacting surface which functions as the first electrode and an uneven surface which functions as the second electrode, wherein:

a recess is formed on the ejection surface of the nozzle plate around the ejection port, the recess having an opening larger than the ejection port and a flat surface perpendicular to an ejection direction of the liquid within a specific distance in the outward radial direction from the edge of the ejection port; and the uneven surface includes the recess and periphery thereof.

7. A mist spraying apparatus, comprising:

a liquid chamber into which liquid is filled;

an ejection port through which the liquid is ejected from the liquid chamber;

a first electrode which is in contact with the liquid and charges the liquid;

a vibration generating device which converts the liquid into droplets by applying vibrational energy to the liquid inside the liquid chamber, thereby generating a charged mist;

a rear surface electrode which is disposed so as to oppose an ejection surface including the ejection port, and holds a liquid receiving medium onto which the charred mist is deposited from the ejection port;

a second electrode which is disposed at a position in an outward radial direction from an edge of the ejection port, and generates an electric field between the second electrode and the rear surface electrode, the electric field accelerating and converging the charged mist ejected from the ejection port toward the liquid receiving medium;

a first nozzle electrode member in which the ejection port is formed, the first nozzle electrode member having a liquid-contacting surface which functions as the first electrode;

a second nozzle electrode member which is disposed on the ejection surface of the first nozzle electrode member at a specific distance in the outward radial direction from the edge of the ejection port, the second nozzle electrode member functioning as the second electrode;

a first voltage application device which applies a first voltage to the first nozzle electrode member; and a second voltage application device which applies a second voltage higher than the first voltage to the second nozzle electrode member.

8. The mist spraying apparatus as defined in claim 7, wherein the second nozzle electrode member includes an electromagnetic lens.

9. A mist spraying method, comprising the steps of:

charging liquid filled in a liquid chamber by applying a voltage to a first electrode which is in contact with the liquid, and generating a charged mist by convening the liquid into droplets by applying a vibrational energy to the liquid;

ejecting the charged mist through an ejection port toward a liquid receiving medium held on a rear surface electrode disposed so as to oppose an ejection surface including the ejection port of the charged mist;

generating a nonuniform electric field between a second electrode and the rear surface electrode, the second electrode being disposed at a position in an outward radial direction from an edge of the ejection port; and depositing the charged mist on the liquid receiving medium, by accelerating and converging the charged mist, by means of electrostatic force of the nonuniform electric fields wherein the charged mist is a cluster of a plurality of fine droplets of the liquid.

* * * * *